US005473342A

United States Patent [19]

Tse et al.

[11] Patent Number: 5,473,342

[45] Date of Patent: Dec. 5, 1995

[54] METHOD AND APPARATUS FOR ON-THE-FLY MULTIPLE DISPLAY MODE SWITCHING IN HIGH-RESOLUTION BITMAPPED GRAPHICS SYSTEM

[75] Inventors: Lawrence T. Tse, Fremont; Tat C. Choi, Milpitas; David C. Soo, Fremont, all of Calif.

[73] Assignee: Chrontel, Inc., San Jose, Calif.

[21] Appl. No.: 138,954

[22] Filed: Oct. 19, 1993

[51] Int. Cl.[6] ..... G09G 1/02

[52] U.S. Cl. ..... 345/132; 345/150; 345/199; 345/186

[58] Field of Search ..... 345/132, 116, 345/115, 114, 186, 113, 150; 395/131, 199

[56] References Cited

U.S. PATENT DOCUMENTS

| | | | |
|---|---|---|---|
| 4,979,738 | 12/1990 | Frederiksen | 345/132 |
| 5,086,295 | 2/1992 | Boettcher et al. | 345/132 |
| 5,128,658 | 7/1992 | Pappas et al. | 345/114 |
| 5,189,401 | 2/1993 | Kugler, Jr. et al. | 345/132 |
| 5,258,826 | 11/1993 | Wakeland et al. | 345/115 |

OTHER PUBLICATIONS

"IMG G174 high colour palette–DAC with PixMix"; INMOS Limited, a member of the SGS–THOMSON Microelectronics Group; Nov. 1991; #42 1543 00.

*Primary Examiner*—Richard Hjerpe
*Assistant Examiner*—Lun-Yi Lao
*Attorney, Agent, or Firm*—Flehr, Hohbach, Test, Albritton & Herbert

[57] ABSTRACT

A RAMDAC circuit drives a display device so as display multiple modes of color depth and display resolution in a single display frame without sacrificing resolution of the higher-resolution mode, and adjusts the output pixel rate to match that of the display mode being display on a pixel-by-pixel basis. The RAMDAC circuit switches between two graphics modes on-the-fly on a pixel-by-pixel basis in accordance with mode control bits stored in the pixel data. Furthermore, the RAMDAC circuit switches between two output pixel rates such that the amount of video memory used for any predefined screen area remains constant even though the output pixel rate and resolution are dynamically adjusted. In a preferred embodiment a display mode signal is embedded in the display data such that the display data, including the mode signal, comprises one byte of data for each display pixel when the mode signal specifies the first display mode, and comprises two bytes of data for each display pixel when the mode signal specifies the second display mode.

8 Claims, 11 Drawing Sheets

| (r,c) | 1 | 2 | 3 | 4 |
|---|---|---|---|---|
| 1 | P1 | P2 | P3 | P4 |
| 2 | P5 | P6 | P7 | P8 |
| 3 | P9 | P10 | P11 | P12 |
| 4 | P13 | P14 | P15 | P16 |

| Display Memory Address | Pixel Position (r,c) | Memory Content [7,0] |
|---|---|---|
| 1 | 1,1 | PPPPPPPP |
| 2 | 1,2 | PPPPPPPP |
| 3 | 1,3 | PPPPPPPP |
| 4 | 1,4 | PPPPPPPP |
| 5 | 2,1 | PPPPPPPP |
| 6 | 2,2 | PPPPPPPP |
| 7 | 2,3 | PPPPPPPP |
| 8 | 2,4 | PPPPPPPP |
| 9 | 3,1 | PPPPPPPP |
| 10 | 3,2 | PPPPPPPP |
| A | 3,3 | PPPPPPPP |
| B | 3,4 | PPPPPPPP |
| C | 4,1 | PPPPPPPP |
| D | 4,2 | PPPPPPPP |
| E | 4,3 | PPPPPPPP |
| F | 4,4 | PPPPPPPP |

FIG. 2A

| (r,c) | 1 | 2 | 3 | 4 |
|---|---|---|---|---|
| 1 | B1 | B2 | B3 | B4 |
| 2 | B5 | B6 | B7 | B8 |
| 3 | B9 | B10 | B11 | B12 |
| 4 | B13 | B14 | B15 | B16 |

| Display Memory Address | Pixel Position (r,c) | Memory Content [7,0] |
|---|---|---|
| 0 | 1,1 | GGGBBBBB |
| 1 | 1,1 | XRRRRRGG |
| 2 | 1,2 | GGGBBBBB |
| 3 | 1,2 | XRRRRRGG |
| 4 | 1,3 | GGGBBBBB |
| 5 | 1,3 | XRRRRRGG |
| 6 | 1,4 | GGGBBBBB |
| 7 | 1,4 | XRRRRRGG |
| 8 | 2,1 | GGGBBBBB |
| 9 | 2,1 | XRRRRRGG |
| A | 2,2 | GGGBBBBB |
| B | 2,2 | XRRRRRGG |
| C | 2,3 | GGGBBBBB |
| D | 2,3 | XRRRRRGG |
| E | 2,4 | GGGBBBBB |
| F | 2,4 | XRRRRRGG |
| 10 | 3,1 | GGGBBBBB |
| 11 | 3,1 | XRRRRRGG |
| 12 | 3,2 | GGGBBBBB |
| 13 | 3,2 | XRRRRRGG |
| 14 | 3,3 | GGGBBBBB |
| 15 | 3,3 | XRRRRRGG |
| 16 | 3,4 | GGGBBBBB |
| 17 | 3,4 | XRRRRRGG |
| 18 | 4,1 | GGGBBBBB |
| 19 | 4,1 | XRRRRRGG |
| 1A | 4,2 | GGGBBBBB |
| 1B | 4,2 | XRRRRRGG |
| 1C | 4,3 | GGGBBBBB |
| 1D | 4,3 | XRRRRRGG |
| 1E | 4,4 | GGGBBBBB |
| 1F | 4,4 | XRRRRRGG |

FIG. 2B

| (r,c) | 1 | 2 | 3 | 4 |
|---|---|---|---|---|
| 1 | P1 | P2 | P3 | P4 |
| 2 | P5 | B1 | B2 | P6 |
| 3 | P7 | B3 | B4 | P8 |
| 4 | P9 | P10 | P11 | P12 |

| Display Memory Address | Pixel Position (r,c) | Memory Content [7,0] |
|---|---|---|
| 0 | 1,1 | PPPPPPPP |
| 1 | 1,1 | 0XXXXXXX |
| 2 | 1,2 | PPPPPPPP |
| 3 | 1,2 | 0XXXXXXX |
| 4 | 1,3 | PPPPPPPP |
| 5 | 1,3 | 0XXXXXXX |
| 6 | 1,4 | PPPPPPPP |
| 7 | 1,4 | 0XXXXXXX |
| 8 | 2,1 | PPPPPPPP |
| 9 | 2,1 | 0XXXXXXX |
| A | 2,2 | GGGBBBBB |
| B | 2,2 | 1RRRRRGG |
| C | 2,3 | GGGBBBBB |
| D | 2,3 | 1RRRRRGG |
| E | 2,4 | PPPPPPPP |
| F | 2,4 | 0XXXXXXX |
| 10 | 3,1 | PPPPPPPP |
| 11 | 3,1 | 0XXXXXXX |
| 12 | 3,2 | GGGBBBBB |
| 13 | 3,2 | 1RRRRRGG |
| 14 | 3,3 | GGGBBBBB |
| 15 | 3,3 | 1RRRRRGG |
| 16 | 3,4 | PPPPPPPP |
| 17 | 3,4 | 0XXXXXXX |
| 18 | 4,1 | PPPPPPPP |
| 19 | 4,1 | 0XXXXXXX |
| 1A | 4,2 | PPPPPPPP |
| 1B | 4,2 | 0XXXXXXX |
| 1C | 4,3 | PPPPPPPP |
| 1D | 4,3 | 0XXXXXXX |
| 1E | 4,4 | PPPPPPPP |
| 1F | 4,4 | 0XXXXXXX |

FIG. 2C

| (r,c) | 1 | 2 | 3 | 4 |
|---|---|---|---|---|
| 1 | P1 | P2 | P3 | P4 |
| 2 | P5 | B1 | | P6 |
| 3 | P7 | B2 | | P8 |
| 4 | P9 | P10 | P11 | P12 |

| Display Memory Address | Pixel Position (r,c) | Memory Content [7,0] |
|---|---|---|
| 1 | 1,1 | PPPPPPP0 |
| 2 | 1,2 | PPPPPPP0 |
| 3 | 1,3 | PPPPPPP0 |
| 4 | 1,4 | PPPPPPP0 |
| 5 | 2,1 | PPPPPPP0 |
| 6 | 2,2 | GGBBBBB1 |
| 7 | 2,3 | RRRRRGGG |
| 8 | 2,4 | PPPPPPP0 |
| 9 | 3,1 | PPPPPPP0 |
| 10 | 3,2 | GGBBBBB1 |
| A | 3,3 | RRRRRGGG |
| B | 3,4 | PPPPPPP0 |
| C | 4,1 | PPPPPPP0 |
| D | 4,2 | PPPPPPP0 |
| E | 4,3 | PPPPPPP0 |
| F | 4,4 | PPPPPPP0 |

FIG. 2D

| FIG. 5A |
|---|
| FIG. 5B |

METHOD AND APPARATUS FOR ON-THE-FLY MULTIPLE DISPLAY MODE SWITCHING IN HIGH-RESOLUTION BITMAPPED GRAPHICS SYSTEM

The present invention relates to computer visual display control systems, in particular to a control system for a color raster-scan display that allows the simultaneous display of image regions with different spatial resolution and color depth within a single bitmapped graphic display frame. The present invention also permits the efficient use of hardware resources such as memory and pixel-bus bandwidth in a graphics display system especially when displaying information from different multimedia sources.

BACKGROUND OF THE INVENTION

Visual displays in computer systems, such as cathode ray tube (CRT) monitors, are typically driven from integrated circuits that are known as RAMDACs. Such circuits include memory elements for storing digitally encoded display control information, such as color intensity, along with digital-to-analog converters used to drive the monitor itself.

The quality of a color display on a computer screen is determined in part by two characteristics, spatial resolution and color depth. Spatial resolution (usually called simply "resolution") is herein defined as the number of distinct points or distinct pixels displayed (e.g., the number of pixels per inch or per centimeter) on a given area of the screen. Spatial resolution is typically measured in units of (distinct) "dots per horizontal display line". Thus, a higher resolution implies a greater the number of pixels of finer grain are displayed. "Color Depth" refers to the number of different colors that can be displayed on the screen at a given time. The greater the color depth, the more color information is stored for each pixel on the screen, resulting in a greater number of colors available for display.

The bitmapped graphics display subsystem of a typical computer system, shown in FIG. 1, includes a pixel clock generator 10 for generating clock signals on lines 11 and 12, a video display memory 20 for storing a frame of video data, a graphic controller 30 (such as a VGA or SVGA graphics controller), a RAMDAC 40 (which is the subject of the present invention) and a raster scan display monitor 50.

In a bitmapped graphics display subsystem such as the one shown in FIG. 1, higher resolution or greater color depth would require the use of more video memory. The "frame update rate" is equal to the number of times per second that the display is re-written, and thus is equal to the number of times per second that the entire frame buffer of video data must be accessed and displayed. For a given frame update rate, a higher resolution or greater color depth would also result in higher bandwidth requirements for the memory bus 21 and the pixel bus 31. For a given amount of video memory and bus bandwidth, there is a trade-off between resolution and color depth. That is, the greater the number of pixels (higher resolution) in a display, the less color information (color depth) can be stored for a given amount of frame buffer storage, and vice-versa.

A variety of display "modes" have been developed for driving color raster-scan displays that specify a particular resolution and a particular color depth. In general, the display modes are classified on the basis of the amount of color information used to generate an individual pixel. Some of these have become de facto standards. For example, in IBM-compatible personal computers two of the most commonly used color display modes are known as the "bypass 555" mode and the "pseudo-color" mode.

In pseudo-color mode, the color and intensity of each pixel is specified or selected by a 8-bit (i.e, one byte) quantity. The 8-bit quantity is used to address three color palette RAM (random access memory) arrays in the RAMDAC chip 40. The three color palette RAM arrays (also collectively called the color map RAM or the RAMDAC memory) contain the color information that is used to control the D/A converter, which in turn drives the red, green and blue signals of the CRT. In the pseudo-color mode only 256 different colors can be displayed on screen at one time, since eight bits can only specify 256 different RAM array address values.

The bypass 555 mode (also known as the TARGA format) has a color depth of 15 bits, allowing a large selection of colors to be displayed on a screen at once. In the bypass 555 mode each pixel is stored as a 16-bit value, with one bit being unused. In this mode, the RAMDAC memory is bypassed and three different sets of five bits from each 16-bit pixel are used to control each of the three D/A converters. In this mode there are 32 possible intensity levels for each of the three primary colors (red, green and blue) resulting in a total of 32768 different colors that can be displayed. Since almost twice as many bits of color data must be provided for each pixel (compared with the 8-bit of color information provided by each pixels in the pseudo-color mode), the resolution of the display is reduced by a factor of two for a pixel bus operating at the same data transfer rate used in the pseudo-color mode. Similarly, for a fixed amount of video memory that is sufficient to store the pixel data for only one display frame in pseudo-color mode, the resolution of the display is reduced by a factor of two when that same video memory is used with a display 50 operating in the bypass 555 mode.

Besides the bypass 555 mode, there are a variety of other display modes used by prior art bitmapped graphics system that provide more color depth than the pseudo-color mode. All of these display modes require more than eight bits of video data per pixel. For the remainder of this document, the bypass 555 mode and these other modes will be collectively referred to as "multicolor" modes.

To explain the relationship between displayed pixels and the utilization of display memory 20, FIGS. 2A–2D show examples of memory bitmaps for a display frame of four rows and four columns of pixels in various display modes. For the purposes of this discussion we will treat each 8-bit quantity stored in the display memory 20 as being stored at a distinct memory address. While most display memories are organized as 32-bit or 64-bit wide memories, each 8-bit byte quantity stored in the display memory 20 can be individually defined and updated by the computer system's CPU 72, and thus each 8-bit quantity can be individually "addressed", even if that address is identifies a certain portion of the 32-bit or 64-bit word at a particular memory address. Table 1 defines the pixel and video bit data labelling conventions used in FIGS. 2A–2D.

TABLE 1

Key to Pixel and Bit Labels in FIGS. 2A–2D

| Symbol | Description |
|---|---|
| P1, P2, . . . | indicates a pseudo-color pixels; |
| B1, B2, . . . | indicates bypass 555 mode pixels; |
| R | indicates a red intensity bit value; |

TABLE 1-continued

| Key to Pixel and Bit Labels in FIGS. 2A–2D | |
|---|---|
| Symbol | Description |
| G | indicates a green intensity bit value; |
| B | indicates a blue intensity bit value; |
| X | indicates a "don't care" bit whose value is ignored; |
| 1 | enables bypass 555 display mode; and |
| 0 | enables pseudo-color display mode (or disables bypass mode). |

In FIG. 2A, the pseudo-color information for each pixel is stored as an 8-bit quantity in video memory 20. FIG. 2B is an example of a memory bitmap for a 4 by 4 pixel frame in bypass 555 mode. Each pixel in FIG. 2B requires two bytes of memory in the video memory 20, and hence the size of the video memory required for this display mode is twice that required for pseudo-color mode. In addition, if the refresh rate is the same as that of the pseudo-color mode, the bandwidth of the video memory bus 21 must also be doubled.

A computer graphics system can be used to display text information, computer generated graphics like icon, still photography, full motion video, etc. Depending on the color content and the resolution requirement of the subject, different display modes may be suitable. For example, text information which has low color content should be displayed in pseudo-color mode for efficient memory usage and high spatial resolution, while motion video, which usually has a lower resolution requirement than that of text, should be displayed in a multicolor mode like the bypass 555 for more color content. In fact there is an increasing interest in being able to mix different color modes within the same screen for the display of different subjects.

A number of commercially available RAMDACs offer the capability to mix pseudo-color and multicolor modes on the same frame. However, prior art RAMDACs cannot change spatial resolution or, equivalently, the output pixel rate, on the fly and therefore the spatial resolution of the displayed image produced by those devices remain constants for the entire display screen. In addition, prior art RAMDACs require that the same amount of memory (e.g., two bytes per pixel) be used for all pixels in the display when mixing pseudo-color and multicolor modes in a single display frame. Thus, prior to the present invention, the normal trade-off between spatial resolution and color depth that applies when selecting pseudo-color mode or a multicolor mode for an entire display screen was not available when psuedocolor and multicolor modes were mixed in a single screen. As a result, in order to utilize the mixed mode of operation using prior art RAMDACs, the size of the video memory 20 must be double what would otherwise be needed.

FIG. 2C is an example of a bitmap for a 4 by 4 pixel frame in the prior-art mixed mode system where pseudo-color mode is mixed with a bypass 555 mode. Two bytes of data are required per pixel regardless of whether the display is in pseudo-color mode or bypass 555 mode. One bit out of the two bytes is used to signal whether the pair represents pseudo-color or bypass 555 information. If the bypass mode is indicated, the remaining 15 bits are read as bypass 555 color data. However, if the pseudo-color mode is indicated, then eight bits of the two bytes are used to address the RAM as in the pseudo-color mode and the remaining 7 bits are ignored. Since pseudo-color mode normally only requires one byte per pixel, both bus bandwidth and memory are not fully utilized when the system is switched into pseudo-color mode. The memory size and memory bus bandwidth requirements are the same as that of the bypass 555 mode and doubled when compared to pseudo-color mode. As shown in FIG. 2C, many "Don't Care" bits (indicated by X's) are stored in the video memory in order to achieve linear address mapping to pixel location, clearly indicating that large portions of the video memory are wasted for storing pseudo-color pixels.

It is an objective of this invention to provide a RAMDAC circuit that has the capability to display two or more modes of different color depth simultaneously in a single display frame and to switch its output pixel rate on-the-fly (at any position in a display image) according to the color depth of the pixel being displayed such that display data with lesser color depth and higher spatial resolution can be displayed along side display data with more color depth but lower spatial resolution.

It is another objective of this invention to use such a RAMDAC circuit to switch between a high-resolution graphics mode such as a 7-bit pseudo-color mode and multicolor mode such as the bypass 555 mode so as to allow for maximum resolutions in both modes for a given amount of video memory.

It is another objective of this invention to use such a RAMDAC chip to switch between a high-resolution graphics mode such as the 7-bit pseudo-color mode and multicolor mode such as the bypass 555 mode so as to allow for maximum and efficient usage of the display memory, for a consistent memory organization with linear address mapping and for reduction in bus bandwidth requirements.

SUMMARY OF THE INVENTION

The present invention includes a RAMDAC circuit that can drive a display device so as display multiple modes of color depth and display resolution in a single display frame without sacrificing resolution of the higher-resolution mode, and that adjusts the output pixel rate to match that of the display mode being display on a pixel-by-pixel basis. The RAMDAC circuit of the present invention switches between two graphics modes on-the-fly on a pixel-by-pixel basis in accordance with mode control bits stored in the pixel data. Furthermore, the RAMDAC circuit switches between two output pixel rates such that the amount of video memory used for any predefined screen area remains constant even though the output pixel rate and resolution are dynamically adjusted.

A pixel data input port of the RAMDAC circuit receives display data representing display pixels at a fixed data input rate, and simultaneously receives a mode signal which specifies either a first display mode or a second display mode. The received display data has a first data format with a first number of data bits per display pixel when the mode signal specifies the first display mode and has a second distinct data format with a second distinct number of data bits per pixel when the mode signal specifies the second display mode. The mode signal can change value on a pixel-by-pixel basis while display data for a single display frame is being received when the single display frame includes display data in both the first and second data formats.

Three digital to analog converters convert three color data signals into a three analog display signals that are transmitted to a display device. Data routing circuitry conveys pixel data corresponding to the received display data to the digital to analog converters. The routing circuitry transmits pixel data for distinct pixels to the digital to analog converters at a first pixel transfer rate when the mode signal specifies the first display mode and transmitting pixel data for distinct pixels to the digital to analog converters at a second pixel transfer rate when the mode signal specifies the second display mode. The two pixel transfer rates are inversely related to the number of bits of display data used to define each pixel, and the spatial resolution of resulting displayed image is therefore also inversely related to the number of bits of display data used to define each pixel.

The data routing circuitry includes a color palette memory for converting the first number of bits of display data into three color data values that are output to the digital to analog converters when the mode signal specifies the first display mode, and includes a data path for dividing the second number of bits in the display data into three color data values that are output to the digital to analog converters when the mode signal specifies the second display mode.

In a preferred embodiment the mode signal is embedded in the received display data such that the received data, including the mode signal, comprises one byte of data for each display pixel when the mode signal specifies the first display mode, and comprises two bytes of data for each display pixel when the mode signal specifies the second display mode.

BRIEF DESCRIPTION OF THE DRAWINGS

FIGS. 2A–2D show examples of display memory bitmaps of a 4 by 4 pixel frame for four different display modes.

DESCRIPTION OF THE PREFERRED EMBODIMENTS

Figure 1:
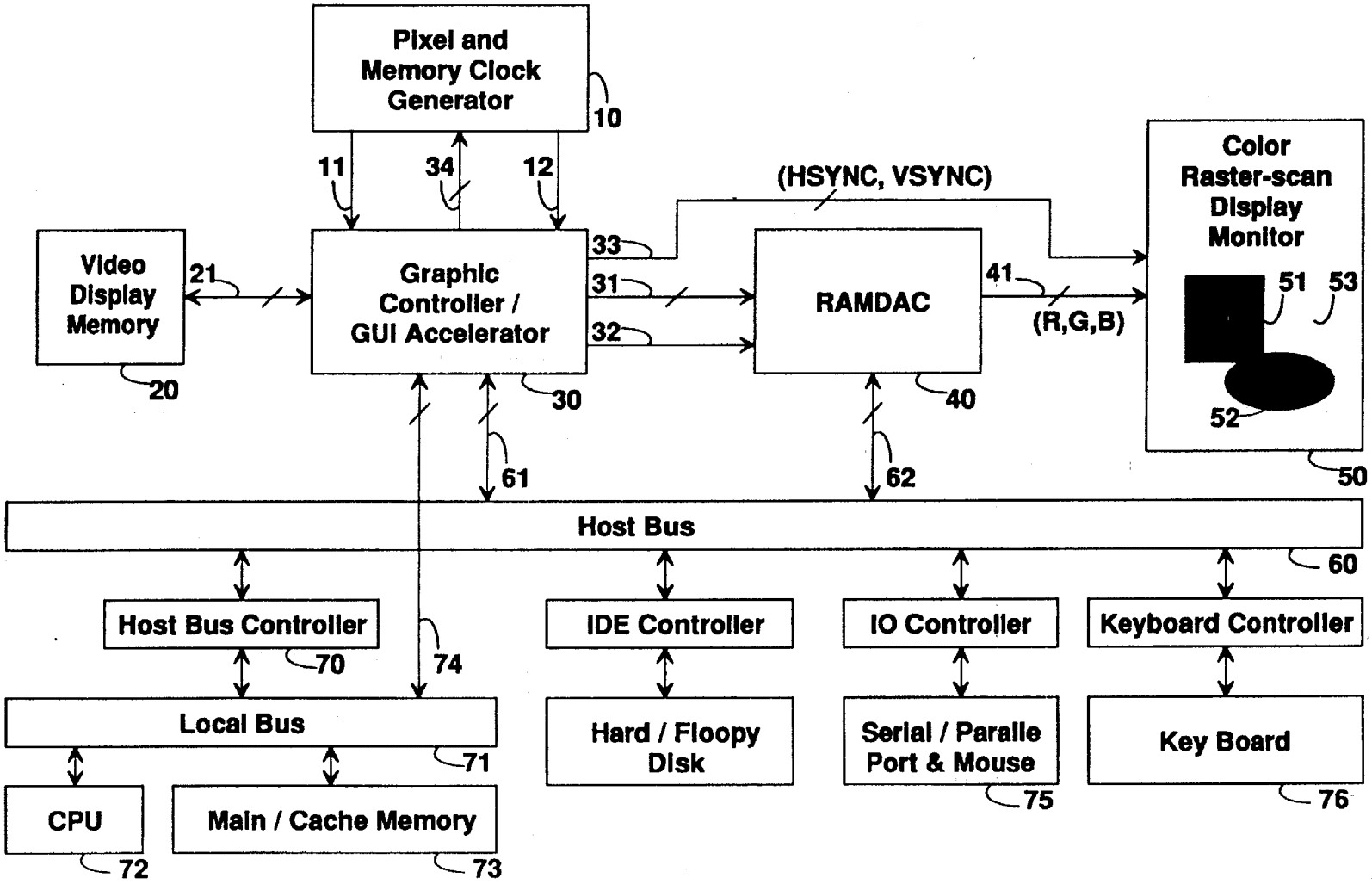
FIG. 1 is a block diagram of a computer graphics display system in which the present invention may be used.

FIG. 1 shows a computer system in connection with which the present invention is used. The computer system includes a central processing unit (CPU) 72, which receives user input from an input device such as a keyboard 76, mouse 75 or the like and generates output graphic information to the user via a display 50. The CPU 72 (such as 80386 or 80486 made by Intel) communicates to the graphic controller or co-processor 30 through the host bus 60 and the CPU's local bus 71. Graphics images to be displayed are represented by data stored in video display memory 20. Each pixel on the displayed image is mapped into a memory location (or memory address) in the display memory 20. The graphics controller 30 continuously reads image data from the display memory 20 from the memory bus 21, converts the color information in the image data to the right format for the current display mode and transmits the formatted image data to the RAMDAC 40 via the pixel bus 31. The RAMDAC 40 then converts, in accordance with the chosen display mode, the received data into RGB data (i.e., Red, Green and Blue data signals) to drive the output digital-to-analog converters in the RAMDAC, which in turn drive the display monitor 50.

The size of the display memory required for an application is given by:

$$\text{Memory Size}=\text{Horizontal Total}\times\text{Vertical Total}\times\text{Color Depth} \quad (1)$$

where Memory Size is in bytes, Horizontal Total is the number of horizontal pixels in the frame, Vertical Total is the number of vertical pixels in the frame and Color Depth is the number of bytes per pixel used to store color information. Note that "Horizontal Total*Vertical Total" represents the resolution of the display. The memory bus bandwidth (for memory bus 21) is given by:

$$\text{Memory Bus Bandwidth}=\text{Memory size}\times\text{Frame Rate} \quad (2)$$

where Frame Rate is the screen refresh rate in frames per second. The pixel bus bandwidth (for pixel bus 31) is given by:

$$\text{Pixel Bus Bandwidth}=\text{Memory Bus Bandwidth}\times(1+\text{Display Overhead}) \quad (3)$$

where Display Overhead is proportional to the size of the dark space around the frame which is usually about 30%. From equations (1) through (3), it can be seen that there is a definite trade off between resolution and color depth for a given amount of display memory, frame rate and bus bandwidth.

If the display information to be used for any particular single display frame is composed of pixels of different color content and resolution requirements, system resources can only be optimized if the display hardware can support both resolution switching and color depth switching on a pixel-by-pixel basis. The present invention makes such a trade-off possible and the video memory bitmap used in the preferred embodiment results in optimal use of system resources.

Consider the requirement (A) to display text information with the highest possible spatial resolution at the highest refresh rate given a certain memory size, bus bandwidth and color depth, and (B) to display simultaneously one or more windows or insets (51,52) of multicolor information such as motion video and still photography.

Since the above requirement calls for the display of multiple multicolor windows of irregular shapes, mode switching information has to be provided for every pixel (or possibly every other pixel) to achieve maximum flexibility in mode switching control. FIG. 2D is the preferred video memory bitmap for a 4 by 4 pixel frame that satisfies the above requirement. When operating in the "Mixed-Color mode" of the present invention, there are two "sub-modes": 7-bit pseudo-color mode and bypass 555 mode. The format of the pixel data stored in video memory consists of 1 bit for mode switching control and 7 bits for addressing the RAM when pseudo-color mode is enabled. When bypass 555 mode is enabled, two consecutive bytes are used with 1 bit for mode switching control, and the remaining 15 bits are used as inputs to the three digital-to-analog converters (DACs) 222. The advantage of this format is that standard 8-bit or 16-bit wide memory chips can be used, and the disadvantage is that the color depth is reduced to 7 bits or 128 levels when the system is switched to pseudo-color mode. However, the present invention can also be applied to other memory formats such as one that switches between 8 bit pseudo-color mode and 16 bit bypass 565 mode with one or more additional bits per pixel being provided for mode switching control.

Comparing the bitmap in FIG. 2C to the one in FIG. 2D, the Mixed-Color mode of the present invention has half the memory size, or equivalently twice the pixel resolution and half the bus bandwidth. When switched to the bypass 555 mode, the resolution on the screen is reduced by a factor of two compared to 7-bit pseudo-color.

Figure 3:
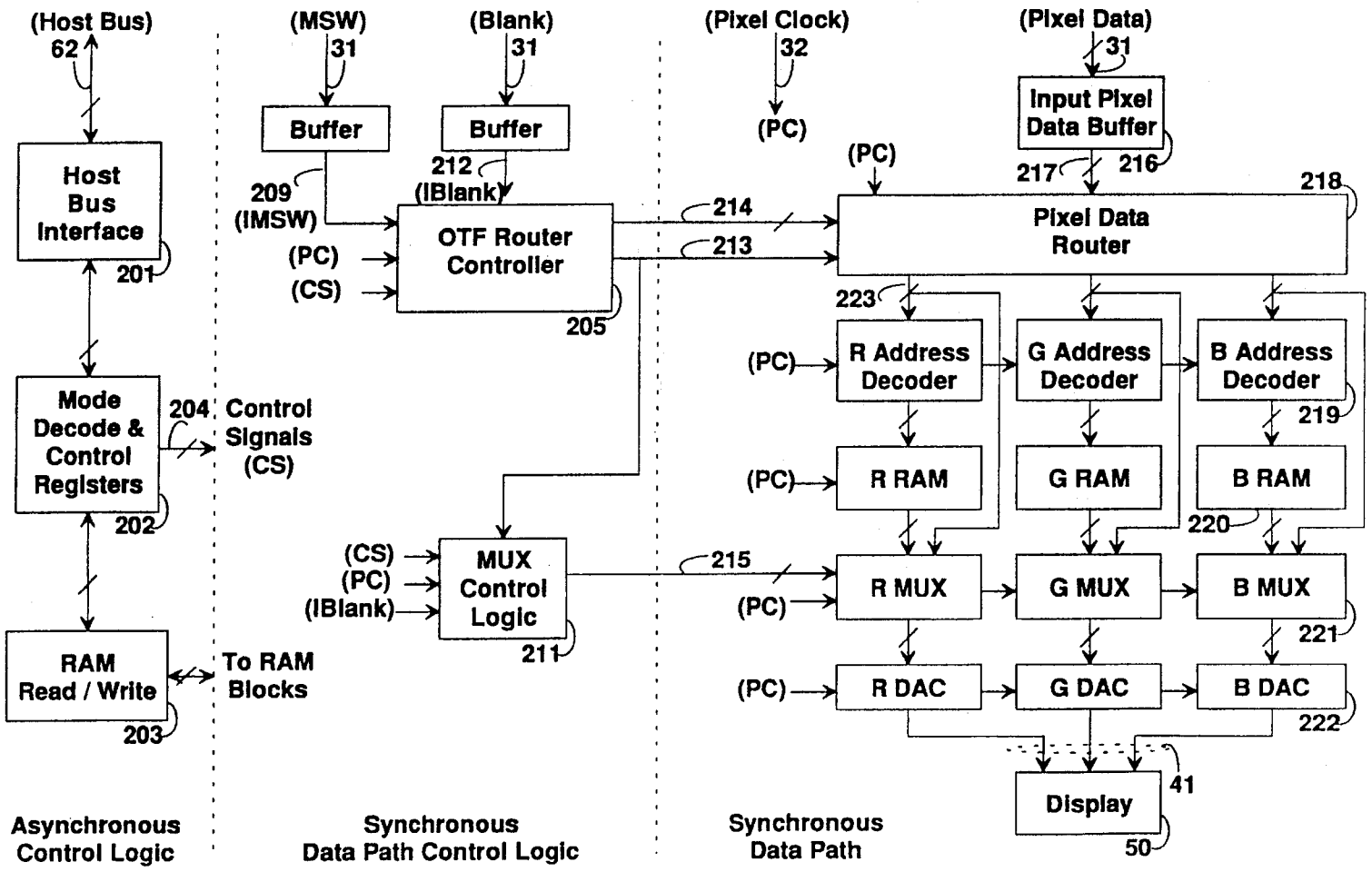
FIG. 3 is a block diagram of the RAMDAC circuit of the preferred embodiment of this invention.

To illustrate the invention, consider the block diagram of a preferred embodiment of the RAMDAC circuit shown in FIG. 3. The circuit architecture shown here can support standard graphic modes as well as the preferred embodiment of the Mixed-Color mode described above. The RAMDAC circuit is divided here into three portions: asynchronous control logic, synchronous data path control logic, and a synchronous data path. A standard asynchronous host interface 201 is used to communicate to the host bus 62 through which commands are sent from the CPU to the RAMDAC's mode decoder and control registers 202, which in turn generate asynchronous control signals CS 204 that are sent to various parts of the synchronous data path control logic which controls the synchronous data path.

The mode decoder in 202 receives a mode selection signal from the host computer that governs the display mode to be used for all display frames until a new mode selection value is received. In accordance with the preferred embodiment, two of the defined mode selection values that can be received from host computer are "mixed color" modes: mixed color mode, which is the primary type of mixed mode described herein, and mixed color memory mode, which will be described below with reference to FIG. 7. The other defined mode selection values that are recognized and decoded by the mode decoder and control registers 202 are the conventional display modes supported by most prior art RAMDAC devices: pseudo-color mode (in which every pixel of each display frame is represented by 8 bits that are used to address all three color palette memories 220), 555 bypass mode and 565 bypass mode (in which every pixel of each display frame is represented by two bytes of data that are passed directly to the three color DACs 222), 555 color mapped mode (in which every pixel of each display frame is represented by two bytes of data that, with five bits of that data being used to address each of the three color palette memories 220), as well as a number of additional display modes well known to those skilled in the art. The mode control decoder and control registers 202 are conventional in design, except that at least two additional mode control values for the mixed color modes are decoded, stored in the control registers, and represented by distinct control signals on the control bus 204. The control signals on 204 related to the mixed color modes are MIXCOLOR_EN, which is enabled (i.e., equal to 1) when the model selection signal from the host corresponds to either of the two mixed color modes supported by the preferred embodiment, and MC15CRM, which is enabled (i.e., equal to 1) when the mode selection signal received from the host selects the mixed color memory mode. Thus, the mixed color mode of operation is identified internally (i.e., in the preferred embodiment of the RAMDAC device) by setting MIXCOLOR_EN=1 and MC15CRM=0 and the mixed color memory mode is identified internally by setting MIXCOLOR_EN=1 and MC15CRM=1.

Color mapping data is also sent from the CPU through the host interface 201 and the RAM read/write circuit 203 to the three color palette RAMs 220. The content of the three color palette RAMs can also be read by the CPU through these interface circuits.

First, consider the operation of the data path when a standard display mode is chosen. The synchronous pixel data path starts by latching the incoming pixel data on pixel bus 31 with an input pixel data latch 216. Pixel data is routed through the pixel data 218 which rearranges the data according to the current mode settings stored in mode registers 202 and outputs it to the three address decoders 219 and the three multiplexers 221. The three multiplexers each select one of their two 8-bit inputs, from either the output of the three color palette RAM's 220 or from the output of the pixel data router 218, as specified by the control signals CS 204. The multiplexers 221 output the data from the pixel data router whenever a bypass display mode is being used, and output the data from the color palette RAMs 220 when a mapped color mode is being used. The data output by the multiplexers 221 is converted by the three DACs 222 into three analog signals on bus 41 that control the intensity of the three primary color signals transmitted to the display 50.

Figure 4:
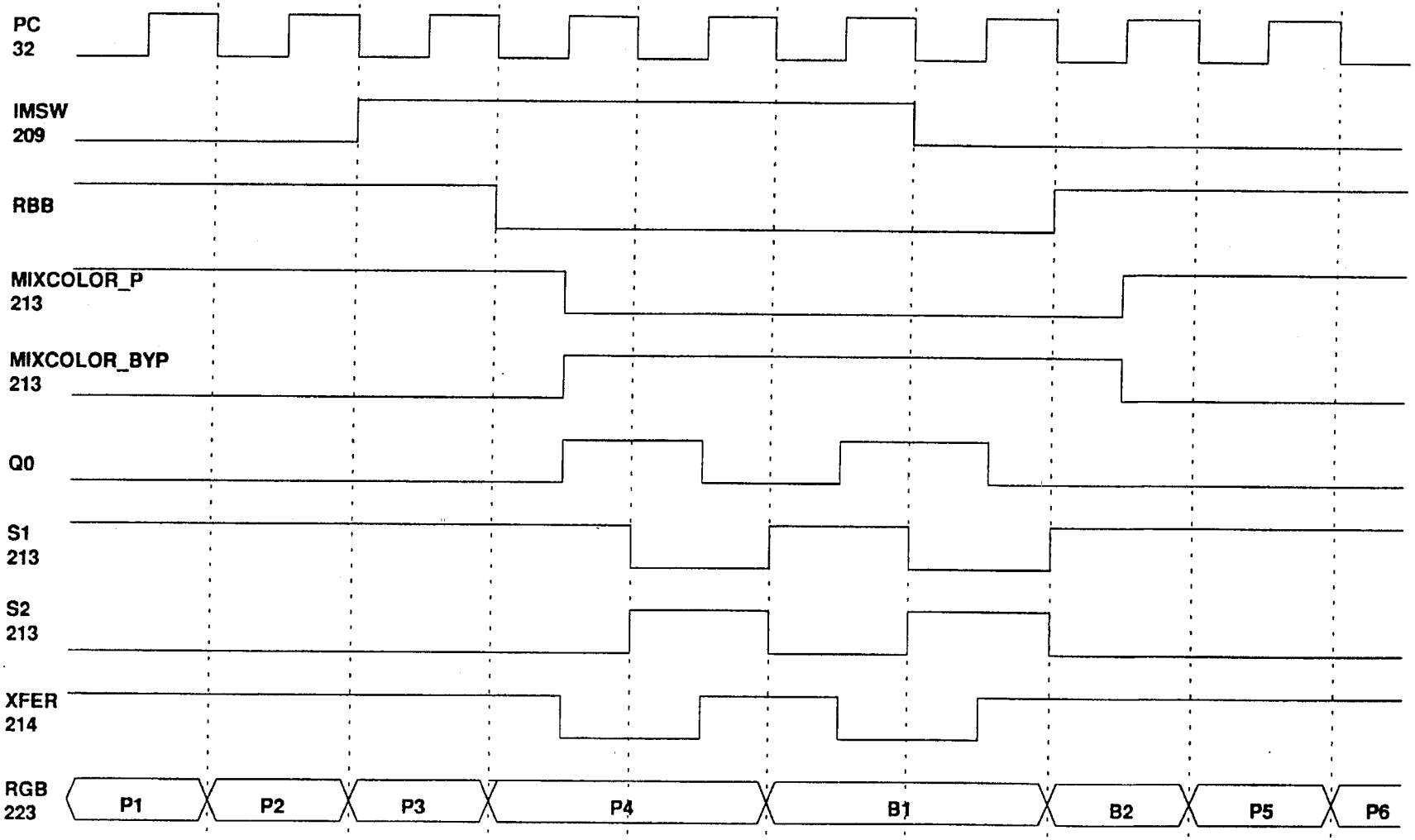
FIG. 4 is a timing diagram of signals in the pixel data router of the preferred embodiment.

The operation of the data path in Mixed-Color mode is similar to that of the standard modes except that the configuration of the pixel data router 218 and the multiplexers 221 are switched on-the-fly and on a pixel-by-pixel basis. The pixel data router 218 not only can change its data path in response to control signals 213, its effective output pixel rate can also be varied by a factor of two in response to a control signal 214. A timing diagram illustrating the interrelationship between the mode switch signal MSW 31 that is embedded in the pixel data and the control signals transmitted on lines 213, 214 and 223 are shown in FIG. 4. Note that the output pixel rate is halved when the system switches to bypass 555 mode and goes back to the higher output rate when the system is switched back to pseudo-color mode.

Figures 5, 5A:
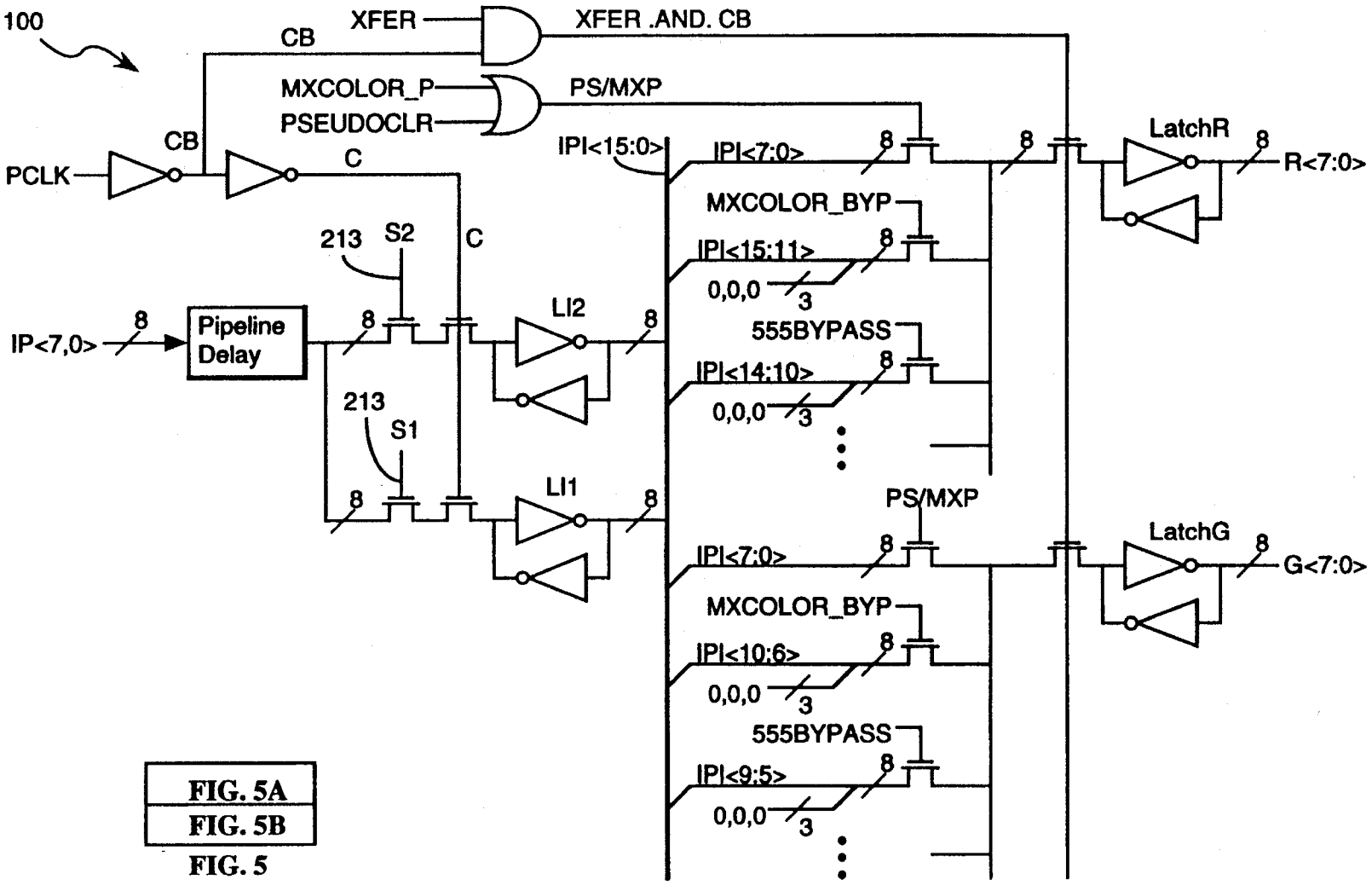
FIGS. 5, **5*a* and 5*b*** show the circuit schematic of the a data router circuit in the preferred embodiment.
Figure 5B:
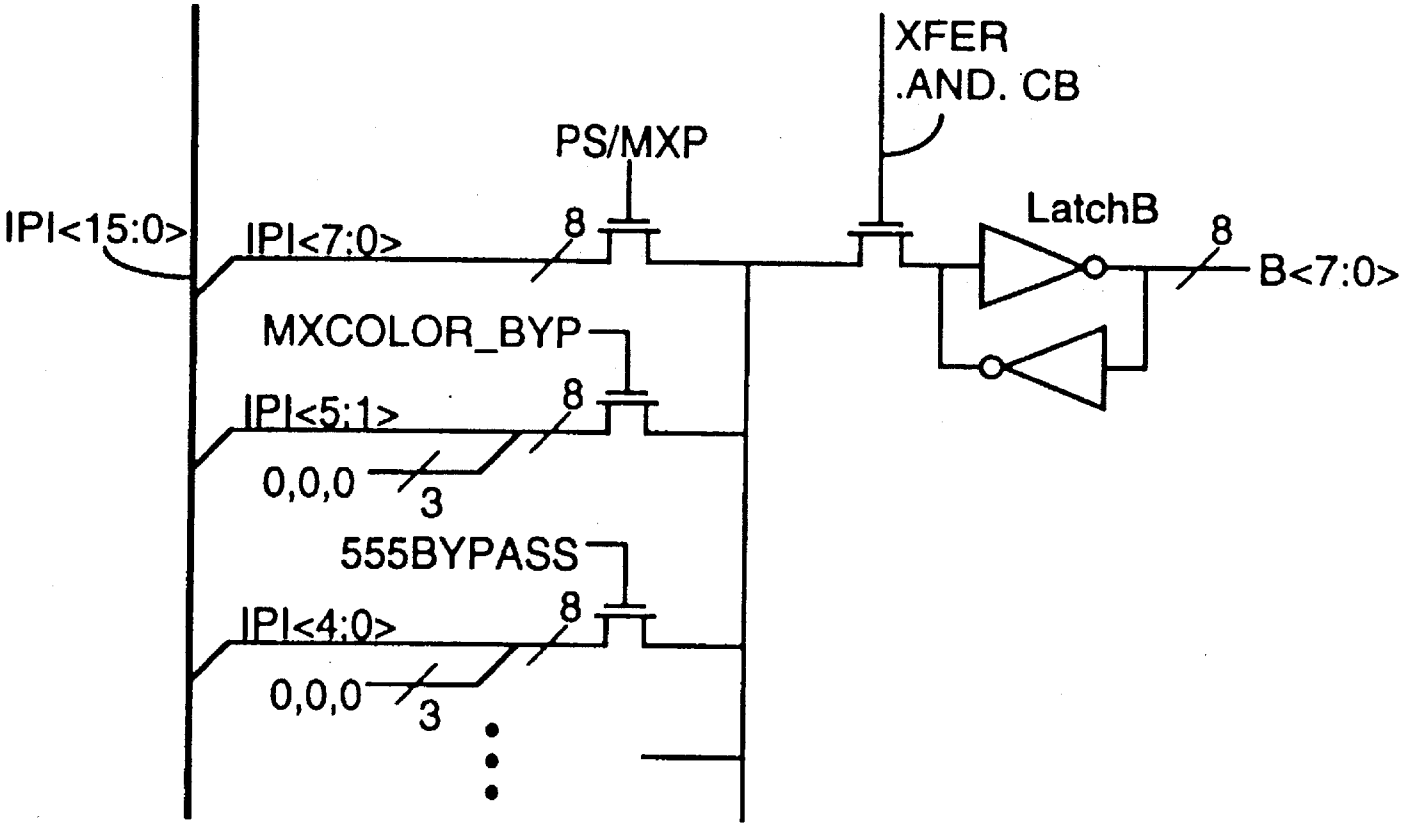

A circuit schematic of the pixel data router 218 is shown in FIG. 5. The input pixel bus is eight bits wide. The pixel data router 218 is designed to support pseudo-color mode, bypass 555 mode and the Mixed-Color mode. Other modes of operation that are supported by many prior art RAMDAC circuits, such as bypass 888 or bypass 565 are not considered here since they are well known to those skilled in the art of RAMDAC design. Inputs to the pixel data router 218 are the pixel clock 32, the 8-bit input pixel data 217, the router control signals on line 213 and the output transfer signal (XFER) 214. The router control signals on line 213 are two input switching signals S1 and S2, and two output switching signals MIXCOLOR P and MIXCOLOR BYP that direct the path of the pixel data to the 24-bit wide output 223 of the pixel data router. In Mixed-Color mode, the data path for pseudo-color mode and bypass 555 mode are enabled by control signals at 213 and 214, which in turn are controlled by the mode switching signal MSW that is embedded in the pixel data.

The pseudo-color mode is switched on (when the embedded MSW signal is low or equal to 0) by setting MIXCOLOR_P high, S1 high, S2 low and XFER high. In pseudo-color mode pixel data is clocked at the pixel clock rate to the internal bus IP<7:0> and then to the three output buses R<7:0>, G<7:0> and B<7:0>. Thus, in pseudo-color mode every byte of pixel data is initially latched by 8-bit transparent latches LI1 and LI2 and is then latched into all three 8-bit output latches LatchR, LatchG and LatchB.

The bypass 555 mode is switched on (when the embedded MSW signal is high or equal to 1) by setting MIXCOLOR P low. In this mode the S1 and S2 signals go high alternately at every other falling edge of the pixel clock and the XFER signal goes high on every other rising edge of the pixel clock after S2 goes high. The first byte of each two-byte "bypass 555 pixel" is latched into 8-bit latch LI1 and the second byte of the bypass 555 pixel data for the same pixel is latched into 8-bit latch LI2. Thus it takes two pixel clock cycles to latch the pixel data for one bypass 555 pixel into the router's input latches. The bypass 555 pixel data is then transferred to the output of the pixel data router at every other falling edge of the pixel clock as follows:

| Output Data Latches | Source of Data |
|---|---|
| LatchR<7-3> | LI2<7-3> = IPI<15-11> |
| LatchR<2-0> | Ground (0's) |
| LatchG<7-3> | LI2<2-0>, LI1<7-6> = IPI<10-6> |
| LatchG<2-0> | Ground (0's) |
| LatchB<7-3> | LI1<5-1> = IPI<5-1> |
| LatchB<2-0> | Ground (0's) |

FIG. 4 shows the details of the timing relationships between the control signals, clock signals and data signals in the pixel data router. The effective output pixel rate is switched between a higher rate and a lower rate according to the transfer control signal XFER 214.

Figure 6:
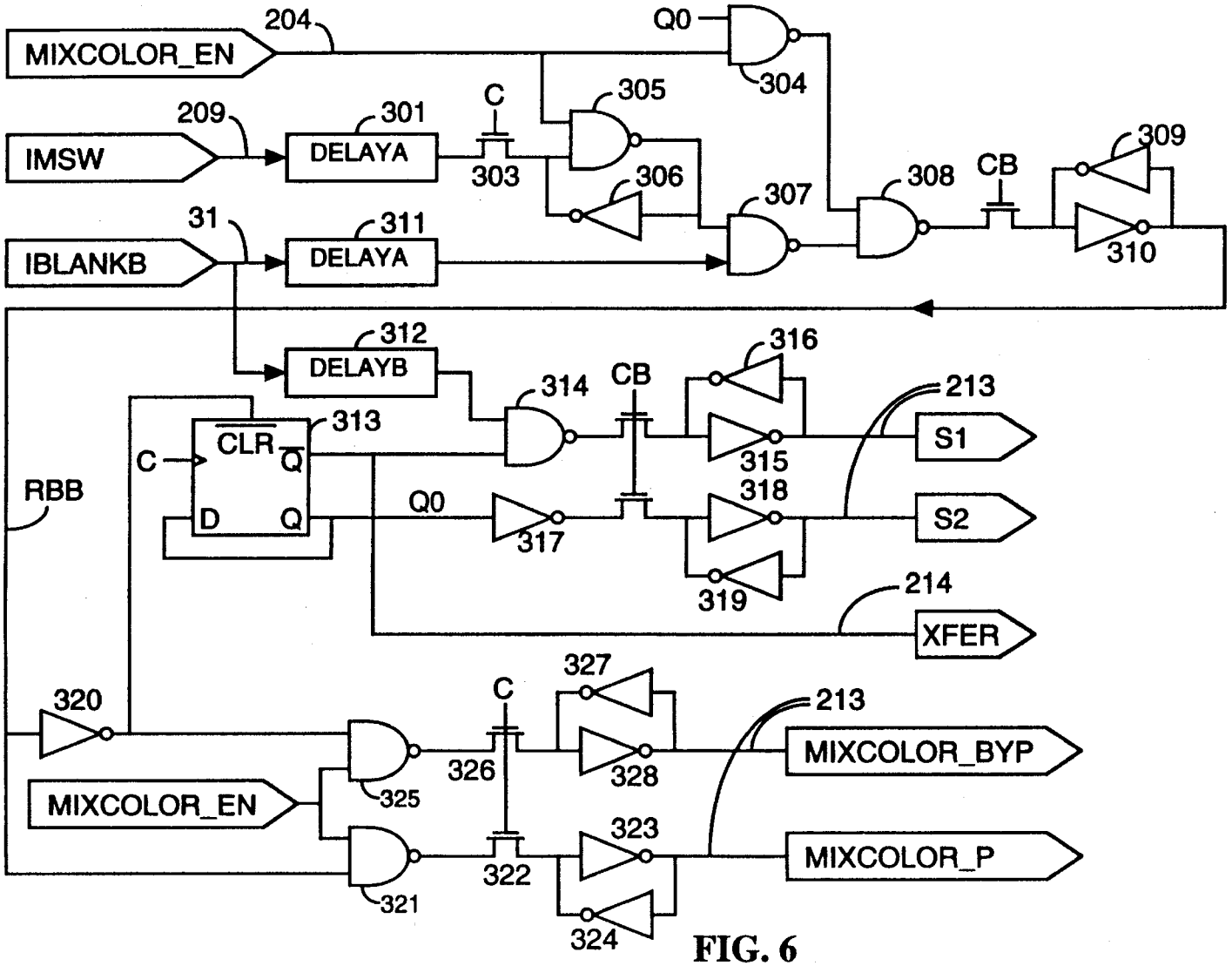
FIG. 6 is the circuit schematic of the on-the-fly (OTF) router controller used in the preferred embodiment.

The on-the-fly router controller 205 of the preferred embodiment is shown in FIG. 6. When the system is in Mixed-Color mode, the MixCOLOR_EN signal 204 is enabled. Circuit elements 302 to 310 decode IBLANK 212 (i.e., the internal, buffered version of the blanking signal) and the IMSW 209 signals on-the-fly, on a pixel-by-pixel basis. Blanking methods do not form a part of the invention, and for present purpose could be dispensed with; however, the full circuit in FIG. 6 is shown for completeness. Pipeline delay elements 301, 311 and 312 are included here to compensate for delay differences in the IMSW 209, IBLANK 212 and the pixel data path, and are assumed to be zero here. The output of the decode circuitry is RBB which is a delayed and inverted version of the mode switch signal MSW in Mixed-Color mode as shown in FIG. 4. RBB is then used to reset the modulus 2 counter 313 which is shown as a simple D-type flip-flop. If the RAMDAC circuit supports bypass 888 mode, a modulus 3 counter may be required. Output signals S1, S2, MIXCOLOR P and MIXCOLOR_BYP which are collectively identified as being transmitted on control bus 213, are derived by latching the modulus counter's outputs and Reset input at the appropriate clock transition using circuit elements 314 to 328.

TABLE 2

| | Mixed-Color Mode | |
|---|---|---|
| | Pseudo-Color | Bypass 555 |
| MixColor_En | 1 | 1 |
| MSW | 0 | 1 |
| MixColor_P | 1 | 0 |
| MixColor_Byp | 0 | 1 |
| RBB | 1 | 0 |
| S1 | 1 | 010101 . . . |
| S2 | 0 | 101010 . . . |
| Q0 | 0 | 101010 . . . |

IMSW 209 is the internal, buffered version of the MSW signal. In the preferred embodiment the mode switch signal MSW 31 is derived from bit 0 of the pixel bus, which is mapped to display memory as shown by the bitmap in FIG. 2D. We refer to this switching technique as "embedded mode-switching", since the control signal is embedded in the pixel data that is stored in the display memory 20. Alternately, instead of embedded mode-switching, one could use separate hardware counters or the like to generate the mode switch control signal. This is referred to as "hardware mode-switching". Either control method could be used with the present invention. Embedded mode-switching allows more flexibility and is more suitable if multiple irregularly shaped multicolor windows are to be displayed along with pseudo-color windows. A summary of the signals input and output by the on-the-fly router controller 205 is shown in Table 2.

Figure 7:
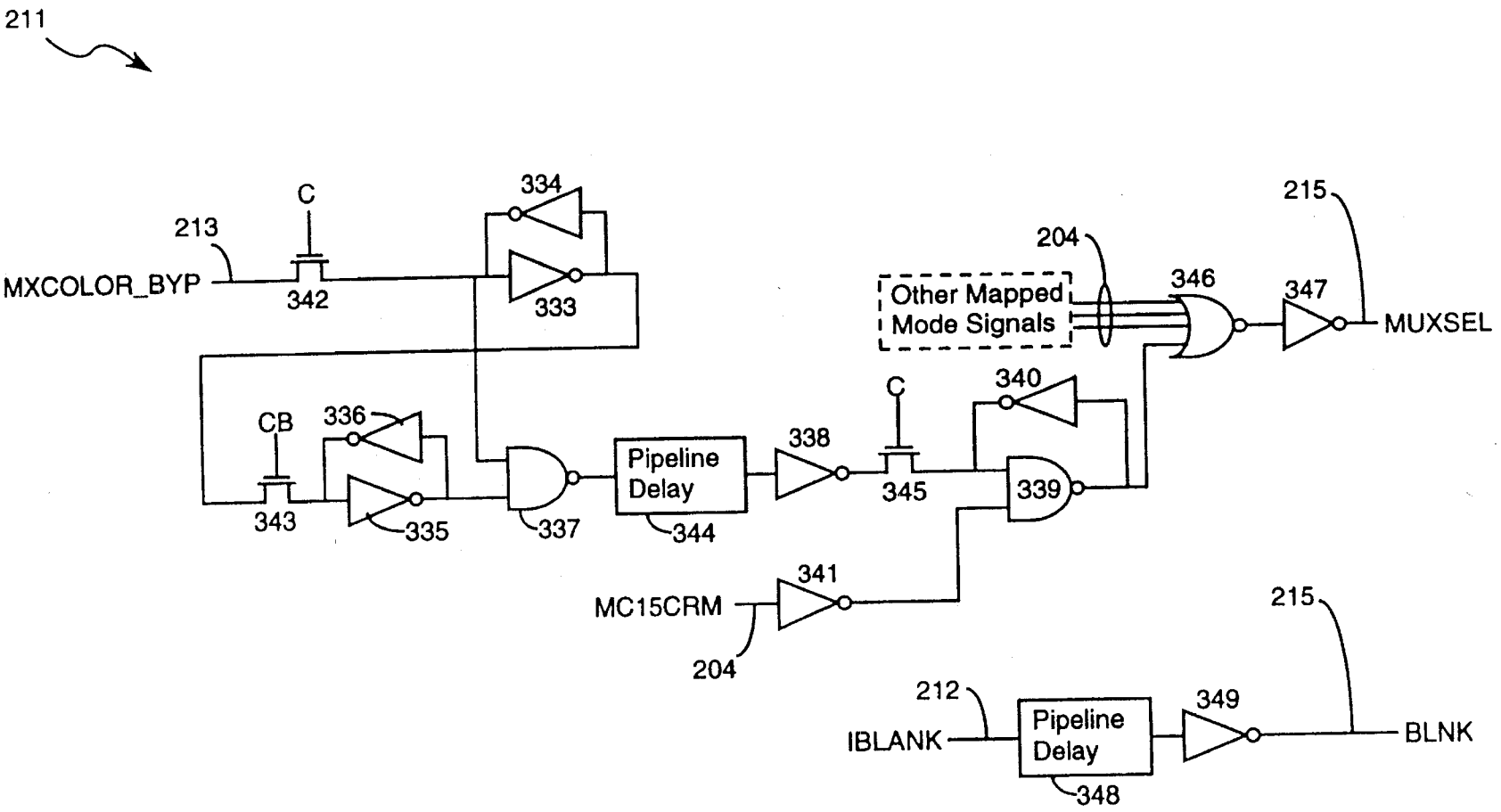
FIG. 7 is the circuit schematic of the multiplexer control logic used in the preferred embodiment.

Referring to FIG. 7, the multiplexer control logic 211 generates the MUXSEL selection signal on line 215 that determines whether the multiplexers 221 output the color mapped data signals received from the color palette memories 220 or the bypass data signals received directly from the router 218. When MUXSEL equals 1, the multiplexers 221 output the signals received from the three color palette memories, and when MUXSEL equals 0 the multiplexers output the bypass data received directly from the router 218. The multiplexer control logic 211 also generates a delayed blanking signal BLNK that, when enabled during horizontal and vertical blanking periods, disables the multiplexers 221 from outputting any signals to the DACs 222.

As shown by FIG. 7, the multiplexer control logic includes a set of delay and logic elements 333–349. These logic elements work as follows. When the mixed color mode or operation is enabled, which means that MC15CRM=0 and that MIXCOLOR_BYP toggles on when a corresponding next pixel to be output by the RAMDAC is a 555 bypass pixel and toggles off when the corresponding next pixel to be output by the RAMDAC is a 7-bit pseudo-color pixel. With an appropriate time delay the MUXSEL signal is equal to the inverse of the MIXCOLOR_BYP signal.

For other display modes, the multiplexer control logic 211 sets the MUXSEL signal equal to 1 for color mapped modes and sets it equal to 0 for bypass modes.

When the mixed color memory operation is enabled, which means that MC15CRM=1, the MUXSEL signal is kept equal to 1, which causes the multiplexers 221 to output the data received to the three color palette memories 220. As a result, in the mixed color memory mode of operation, pixels whose least significant bit is set equal to 0 (herein called pseudo-color pixels) have seven bits of data, and those same seven bits or data are used to address all three color palette memories. Pixels whose least significant bit is set equal to 1 (herein called 555 mapped pixels) have 15 bits of data, and each of the three color palette memories 220 are addressed with a distinct five of those 15 bits. The operation of the pixel data router 218 is identical for both mixed color mode and mixed color memory mode. In addition, the pixel data stored in the video memory is formatted in exactly the same way (as shown in FIG. 2D) in both mixed color modes. However, in mixed color memory mode the multiplexers 221 always output the data received from the color palette memories 220, instead of dynamically switching on a pixel-by-pixel basis between the bypass and color mapped data at the multiplexers' two input ports. Thus, the three video signals generated in response to the "555 mapped pixels" are determined by both the pixel data values and the contents of the color palette memories 220, while the three video signal generated in response to "555 bypass pixels" (used in the mixed color mode) are determined solely by the pixel data values.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims. For instance, the present invention could be used to switch on-the-fly between other types of display modes, such as two bypass display modes with different spatial and color resolutions, or a different combination of bypass and color mapped display modes than the combination used in the preferred embodiment. In all such alternate embodiments, the pixel transfer rate that will be used by the data router circuit will be inversely proportional to the amount of data used to define each pixel. Thus, the spatial resolution of each pixel will be inversely proportional to its color depth, preserving the resolution - color depth tradeoff and maximizing use of the available display memory and bus bandwidth resources of the computer system.

The present invention can be used with a variety of display devices, including display devices that do not require digital to analog converters. Furthermore, the present invention can be used in a graphics circuit that combines the functions of the graphics controller 30 and RAMDAC 40.

What is claimed is:

1. A display control system for transmitting display information to a raster scan display device, comprising:

a display data memory for storing display data, said display data including first data representing first image regions and second data representing second image regions wherein said first and second data are interleaved with each other;

said first image regions having first pixels with a first spatial resolution and a first color depth, said first data including one byte of data representing each first pixel, said one byte including a mode bit representing indicating a first display mode;

said second image regions having second pixels with a second spatial resolution and a second color depth, said second data including N bytes of data representing each second pixel, said N bytes including a mode bit indicating a second display mode; wherein N is an integer selected from the set consisting of 2 and 3, and said second spatial resolution is one Nth of said first spatial resolution;

an input port coupled to said display data memory for receiving said stored display data at a fixed data input rate, and for receiving a pixel clock signal having a fixed clock cycle; said input port receiving said stored display data in the same sequence that said pixels are to be displayed on said display device;

a plurality of digital to analog converters for converting a like plurality of data signals into a like plurality of analog display signals and for transmitting said analog display signals to said display device;

a color palette memory for converting display data into color data values;

a transfer control signal generator coupled to said input port that generates a transfer control signal, said transfer control signal having a first transfer control value when the mode bits in said received display data represent said first display mode and having a second transfer control value when the mode bits in said received display data represent said second display mode; and data routing circuitry, coupled to said transfer control signal generator, said plurality of digital to analog converters, and said color palette memory; said data routing circuitry conveying said received display data one byte at a time to said color palette memory and then conveying the color data values generated by said color palette memory for each display data byte to said digital to analog converters when said transfer control signal is equal to said first transfer control value; said data routing circuitry conveying said received display data N bytes at a time directly to said digital to analog converters, bypassing said color palette memory, when said transfer control signal is equal to said second transfer control value;

wherein said digital to analog converters receive data signals for converting to analog signals at a first rate when said transfer control signal is equal to said first transfer control value and at a second rate equal to one Nth of said first rate when said transfer control signal is equal to said second transfer control value.

2. A display control system for transmitting display information to a raster scan display device, comprising:

a display data memory for storing display data, said display data representing pixels to be transmitted in raster scan order to said display device;

a mode register for storing mode information indicating which of a predefined multiplicity of display modes said is to be used by said display control system; wherein said predefined multiplicity of display modes comprises a pseudocolor mode, a bypass mode, and a mixed color mode;

said stored display data, when said mode information indicates said pseudocolor mode, including one byte of data for each pixel to be transmitted to said display device;

said stored display data, when said mode information indicates said bypass mode, including N bytes of data for each pixel to be transmitted to said display device; wherein N is an integer selected from the set consisting of 2 and 3;

said stored display data, when said mode information indicates said mixed color mode, including first data representing first image regions and second data representing second image regions wherein said first and second data are interleaved with each other;

said first image regions having first pixels with a first spatial resolution and a first color depth, said first data including one byte of data representing each first pixel, said one byte including a mode bit representing indicating a first mixed color display mode;

said second image regions having second pixels with a second spatial resolution and a second color depth, said second data including N bytes of data representing each second pixel, said N bytes including a mode bib indicating a second mixed color display mode; wherein said second spatial resolution is one Nth of said first spatial resolution;

an input port coupled to said display data memory for receiving said stored display data at a fixed data input rate, and for receiving a pixel clock signal having a fixed clock cycle; said input port receiving said stored display data in the same sequence that said pixels are to be displayed on said display device;

a plurality of digital to analog converters for converting a like plurality of data signals into a like plurality of analog display signals and for transmitting said analog display signals to said display device;

a color palette memory for converting display data into color data values;

a transfer control signal generator coupled to said input port that generates a transfer control signal, said transfer control signal having a first transfer control value when said mode information indicates said mixed color mode and the mode bits in said received data represent said first mixed color display mode; said transfer control signal having said first transfer control value when said mode information indicates said pseudocolor mode; said transfer control signal having a second transfer control value, distinct from said first transfer control value, when said mode information indicates said mixed color mode the mode bits in said received display data represent said second mixed color display mode; and said transfer control signal having said second transfer control value when said mode information indicates said bypass mode; and data routing circuitry, coupled to said transfer control signal generator, said plurality of digital to analog converters, and said color palette memory; said data routing circuitry conveying said received display data one byte at a time to said color palette memory and then conveying the color data values generated by said color palette memory for each display data byte to said digital to analog converters when said transfer control signal is equal to said first transfer control value; said data routing circuitry conveying said received display data N bytes at a time directly to said digital to analog converters, bypassing said color palette memory, when said transfer control signal is equal to said second transfer control value;

wherein said digital to analog converters receive display data signals for converting to analog signals at a first rate when said transfer control signal is equal to said first transfer control value and at a second rate equal to one Nth of said first rate when said transfer control signal is equal to said second transfer control value.

3. A method of operating a display control system, comprising the steps of:

providing a display data memory for storing display data, said display data representing pixels to be transmitted in raster scan order to said display device;

said stored display data including first data representing first image regions and second data representing second image regions wherein said first and second data are interleaved with each other;

said first image regions having first pixels with a first spatial resolution and a first color depth, said first data including one byte of data representing each first pixel, said one byte including a mode bit representing indicating a first display mode;

said second image regions having second pixels with a second spatial resolution and a second color depth, said second data including N bytes of data representing each second pixel, said N bytes including a mode bit indicating a second display mode; wherein said second spatial resolution is one Nth of said first spatial resolution;

receiving said stored display data from said display data memory at a fixed data input rate and in the same sequence that said pixels are to be displayed on said display device;

providing a plurality of digital to analog converters for converting a like plurality of data signals into a like plurality of analog display signals and for transmitting said analog display signals to a display device;

providing a color palette memory for converting display data into color data values;

generating a transfer control signal, said transfer control signal having a first transfer control value when the mode bits in said received display data represent said first display mode; said transfer control signal having a second transfer control value, distinct from said first transfer control value, when the mode bits in said received display data represent said second display mode; and conveying said received display data one byte at a time to said color palette memory and then conveying the color data values generated by said color palette memory for each display data byte to said digital to analog converters when said transfer control signal is equal to said first transfer control value; said data routing circuitry conveying said received display data N bytes at a time directly to said digital to analog converters, bypassing said color palette memory, when said transfer control signal is equal to said second transfer control value;

wherein said digital to analog converters receive data signals for converting to analog signals at a first rate when said transfer control signal is equal to said first transfer control value and at a second rate equal to one Nth of said first rate when said transfer control signal is equal to said second transfer control value.

4. A method of operating a display control system, comprising the steps of:

providing a display data memory for storing display data, said display data representing pixels to be transmitted in raster scan order to said display device;

providing a mode register for storing mode information indicating which of a predefined multiplicity of display modes said is to be used by said display control system; wherein said predefined multiplicity of display modes comprises a pseudocolor mode, a bypass mode, and a mixed color mode;

said stored display data, when said mode information indicates said pseudocolor mode, including one byte of data for each pixel to be transmitted to said display device;

said stored display data, when said mode information indicates said bypass mode, including N bytes of data for each pixel to be transmitted to said display device; wherein N is an integer selected from the set consisting of 2 and 3;

said stored display data, when said mode information indicates said mixed color mode, including first data representing first image regions and second data representing second image regions wherein said first and second data are interleaved with each other;

said first image regions having first pixels with a first spatial resolution and a first color depth, said first data including one byte of data representing each first pixel, said one byte including a mode bit representing indicating a first mixed color display mode;

said second image regions having second pixels with a second spatial resolution and a second color depth, said second data including N bytes of data representing each second pixel, said N bytes including a mode bit indicating a second mixed color display mode; wherein said second spatial resolution is one Nth of said first spatial resolution;

receiving said stored display data from said display data memory at a fixed data input rate and in the same sequence that said pixels are to be displayed on said display device;

providing a plurality of digital to analog converters for converting a like plurality of data signals into a like plurality of analog display signals and for transmitting said analog display signals to a display device;

providing a color palette memory for converting display data into color data values;

generating a transfer control signal, said transfer control signal having a first transfer control value when said mode information indicates said mixed color mode and the mode bits in said received display data represent said first mixed color display mode; said transfer control signal having said first transfer control value when said mode information indicates said pseudocolor mode; said transfer control signal having a second transfer control value, distinct from said first transfer control value, when said mode information indicates said mixed color mode the mode bits in said received display data represent said second mixed color display mode; and said transfer control signal having said second transfer control value when said mode information indicates said bypass mode; and conveying said received display data one byte at a time to said color palette memory and then conveying the color data values generated by said color palette memory for each display data byte to said digital to analog converters when said transfer control signal is equal to said first transfer control value; said data routing circuitry conveying said received display data N bytes at a time directly to said digital to analog converters, bypassing said color palette memory, when said transfer control signal is equal to said second transfer control value;

wherein said digital to analog converters receive data signals for converting to analog signals at a first rate when said transfer control signal is equal to said first transfer control value and at a second rate equal to one Nth of said first rate when said transfer control signal is equal to said second transfer control value.

5. A display control system for transmitting display information to a raster scan display device, comprising:

a display data memory for storing display data, said display data including first data representing first image regions and second data representing second image regions wherein said first and second data are interleaved with each other;

said first image regions having first pixels with a first spatial resolution and a first color depth, said first data including one byte of data representing each first pixel, said one byte including a mode bit representing indicating a first display mode;

said second image regions having second pixels with a second spatial resolution and a second color depth, said second data including N bytes of data representing each second pixel, said N bytes including a mode bit indicating a second display mode; wherein N is an integer selected from the set consisting of 2 and 3, and said second spatial resolution is one Nth of said first spatial resolution;

an input port coupled to said display data memory for receiving said stored display data at a fixed data input rate, and for receiving a pixel clock signal having a fixed clock cycle; said input port receiving said stored display data in the same sequence that said pixels are to be displayed on said display device;

a plurality of digital to analog converters for converting a like plurality of data signals into a like plurality of analog display signals and for transmitting said analog display signals to said display device;

three color palette memories for converting display data into color data values;

a transfer control signal generator coupled to said input port that generates a transfer- control signal, said transfer control signal having a first transfer control value when the mode bits in said received display data represent said first display mode and having a second transfer control value when the mode bits in said received display data represent said second display mode; and data routing circuitry, coupled to said transfer control signal generator, said plurality of digital to analog converters, and said three color palette memories; said data routing circuitry conveying said received display data one byte at a time to each of said three color palette memories and then conveying the color data values generated by said three color palette memories for each display data byte to said digital to analog converters when said transfer control signal is equal to said first transfer control value; said routing circuitry conveying N bytes of said received display data at a time, in three distinct parallel portions, to said three color palette memories and then conveying the color data values generated by said three color palette memories to said digital to analog converters when said transfer control signal is equal to said second transfer control value;

wherein said digital to analog converters receive data signals for converting to analog signals at a first rate when said transfer control signal is equal to said first transfer control value and at a second rate equal to one Nth of said first rate when said transfer control signal is equal to said second transfer control value.

6. A display control system for transmitting display information to a raster scan display device, comprising:

a display data memory for storing display data, said display data representing pixels to be transmitted in raster scan order to said display device;

a mode register for storing mode information indicating which off a predefined multiplicity of display modes said is to be used by said display control system; wherein said predefined multiplicity off display modes comprises a pseudocolor mode, a memory mapped mode, and a mixed color mapped mode;

said stored display data, when said mode information indicates said pseudocolor mode, including one byte of data for each pixel to be transmitted to said display device;

said stored display data, when said mode information indicates said memory mapped mode, including N bytes of data for each pixel to be transmitted to said display device; wherein N is an integer selected from the set consisting of 2 and 3;

said stored display data, when said mode information indicates said mixed color mapped mode, including first data representing first image regions and second data representing second image regions wherein said first arid second data are interleaved with each other;

said first image regions having first pixels with a first spatial resolution and a first colon depth, said first data including one byte of data representing each first pixel, said one byte including a mode bit representing indicating a first mixed color display mode;

said second image regions having second pixels with a second spatial resolution and a second color depth, said second data including N bytes of data representing each second pixel, said N bytes including a mode bit indicating a second mixed color display mode; wherein said second spatial resolution is one Nth of said first spatial resolution;

an input port coupled to said display data memory for receiving said stored display data at a fixed data input rate, and for receiving a pixel clock signal having a fixed clock cycle; said input port receiving said stored display data in the same sequence that said pixels are to be displayed on said display device;

a plurality of digital to analog converters for converting a like plurality of data signals into a like plurality of analog display signals and for transmitting said analog display signals to said display device;

three color palette memories for converting display data into color data values;

a transfer control signal generator coupled to said input port that generates a transfer control signal, said transfer control signal having a first transfer control value when said mode information indicates said mixed color mapped mode and the mode bits in said received display data represent said first mixed color display mode; said transfer control signal having said first transfer control value when said mode information indicates said pseudocolor mode; said transfer control signal having a second transfer control value, distinct from said first transfer control value, when said mode information indicates said mixed color mapped mode the mode bits in said received display data represent said second mixed color display mode; and said transfer control signal having said second transfer control value when said mode information indicates said memory mapped mode; and data routing circuitry, coupled to said transfer control signal generator, said plurality of digital to analog converters, and said three color palette memories; said data routing circuitry conveying said received display data one byte at a time to each of said three color palette memories and then conveying the color data values generated by said three color palette memories for each display data byte to said digital to analog converters when said transfer control signal is equal to said first transfer control value; said data routing circuitry conveying said received display data N bytes at a time, in three distinct parallel portions, to said three color palette memories and then conveying the color data values generated by said three color palette memories to said digital to analog converters when said transfer control signal is equal to said second transfer control value;

wherein said digital to analog converters receive data signals for converting to analog signals at a first rate when said transfer control signal is equal to said first transfer control value and at a second rate equal to one Nth of said first rate when said transfer control signal is equal to said second transfer control value.

7. A method of operating a display control system, comprising the steps of:

providing a display data memory for storing display data, said display data representing pixels to be transmitted in raster scan order to said display device;

said stored display data including first data representing first image regions and second data representing second image regions wherein said first and second data are interleaved with each other;

said first image regions having first pixels with a first spatial resolution and a first color depth, said first data including one byte of data representing each first pixel, said one byte including a mode bit representing indicating a first display mode;

said second image regions having second pixels with a second spatial resolution and a second color depth, said second data including N bytes of data representing each second pixel, said N bytes including a mode bit indicating a second display mode; wherein said second spatial resolution is one Nth of said first spatial resolution;

receiving said stored display data from said display data memory at a fixed data input rate and in the same sequence that said pixels are to be displayed on said display device;

providing a plurality of digital to analog converters for converting a like plurality of data signals into a like plurality of analog display signals and for transmitting said analog display signals to a display device;

providing three color palette memories for converting display data into color data values;

generating a transfer control signal, said transfer control signal having a first transfer control value when the mode bits in said received display data represent said first display mode; said transfer control signal having a second transfer control value, distinct from said first transfer control value, when the mode bits in said received display data represent said second display mode; and conveying said received display data one byte at a time to said three color palette memories and then conveying the color data values generated by said three color palette memories for each display data byte to said digital to analog converters when said transfer control signal is equal to said first transfer control value; and conveying said received display data N bytes at a time, in three distinct parallel portions, to said three color palette memories and then conveying the color data values generated by said three color palette memories to said digital to analog converters when said transfer control signal is equal to said second transfer control value;

wherein said digital to analog converters receive data signals for converting to analog signals at a first rate when said transfer control signal is equal to said first transfer control value and at a second rate equal to one Nth of said first rate when said transfer control signal is equal to said second transfer control value.

8. A method of operating a display control system, comprising the steps of:

providing a display data memory for storing display data, said display data representing pixels to be transmitted in raster scan order to said display device;

providing a mode register for storing mode information indicating which of a predefined multiplicity of display modes said is to be used by said display control system; wherein said predefined multiplicity of display modes comprises a pseudocolor mode, a memory mapped mode, and a mixed color mapped mode;

said stored display data, when said mode information indicates said pseudocolor mode, including one byte of data for each pixel to be transmitted to said display device;

said stored display data, when said mode information indicates said memory mapped mode, including N bytes of data for each pixel to be transmitted to said display device; wherein N is an integer selected from the set consisting of 2 and 3;

said stored display data, when said mode information indicates said mixed color mapped mode, including first data representing first image regions and second data representing second image regions wherein said first and second data are interleaved with each other;

said first image regions having first pixels with a first spatial resolution and a first color depth, said first data including one byte of data representing each first pixel, said one byte including a mode bit representing indicating a first mixed color display mode;

said second image regions having second pixels with a second spatial resolution and a second color depth, said second data including N bytes of data representing each second pixel, said N bytes including a mode bit indicating a second mixed color display mode; wherein said second spatial resolution is one Nth of said first spatial resolution;

receiving said stored display data from said display data memory at a fixed data input rate and in the same sequence that said pixels are to be displayed on said display device;

providing a plurality of digital to analog converters for converting a like plurality of data signals into a like plurality of analog display signals and for transmitting said analog display signals to a display device;

providing a three color palette memories for converting display data into color data values;

generating a transfer control signal, said transfer control signal having a first transfer control value when said mode information indicates said mixed color mapped mode and the mode bits in said received data represent said first mixed color display mode; said transfer control signal having said first transfer control value when said mode information indicates said pseudocolor mode; said transfer control signal having a second transfer control value, distinct from said first transfer control value, when said mode information indicates said mixed color mapped mode the mode bits in said received display data represent said second mixed color display mode; and said transfer control signal having said second transfer control value when said mode information indicates said memory mapped mode; and conveying said received display data one byte at a time to said three color palette memories and then conveying the color data values generated by said three color palette memories for each display data byte to said digital to analog converters when said transfer control signal is equal to said first transfer control value; and conveying N bytes of said received display data at a time, in three distinct parallel portions, to said three color palette memories and then conveying the color data values generated by said three color palette memories to said digital to analog converters when said transfer control signal is equal to said second transfer control value;

wherein said digital to analog converters receive display data signals for converting to analog signals at a first rate when said transfer control signal is equal to said first transfer control value and at a second rate equal to one Nth of said first rate when said transfer control signal is equal to said second transfer control value.

* * * * *